US008808647B2

(12) United States Patent
Cherubini et al.

(10) Patent No.: US 8,808,647 B2
(45) Date of Patent: Aug. 19, 2014

(54) MULTI-WELL PLATE WITH TAILORED CHAMBERS

(75) Inventors: Claudio Cherubini, Cham (CH); Nicole Gwerder, Root (CH); Martin Kopp, Huenenberg See (CH); Edwin Oosterbroek, Cham (CH); Emad Sarofim, Hagendorn (CH)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 1137 days.

(21) Appl. No.: 12/556,925

(22) Filed: Sep. 10, 2009

(65) Prior Publication Data

US 2010/0064781 A1 Mar. 18, 2010

(30) Foreign Application Priority Data

Sep. 12, 2008 (EP) ..... 08105327

(51) Int. Cl.
*B01L 3/00* (2006.01)

(52) U.S. Cl.
CPC ..... *B01L 3/50851* (2013.01)
USPC ..... 422/553

(58) Field of Classification Search
CPC ..... B01L 3/5085; B01L 2300/0829; B01L 3/50851
USPC ..... 422/552, 553
See application file for complete search history.

(56) References Cited

U.S. PATENT DOCUMENTS

| | | | | |
|---|---|---|---|---|
| 6,051,191 | A * | 4/2000 | Ireland | 422/553 |
| 2002/0072096 | A1 | 6/2002 | O'Keefe et al. | |
| 2003/0034306 | A1 * | 2/2003 | Schulte et al. | 210/650 |
| 2003/0170833 | A1 | 9/2003 | Lassner et al. | |
| 2004/0214315 | A1 | 10/2004 | Saluz et al. | |
| 2004/0247490 | A1 * | 12/2004 | Olivier et al. | 422/101 |
| 2007/0202538 | A1 * | 8/2007 | Glezer et al. | 435/7.1 |

FOREIGN PATENT DOCUMENTS

| | | | |
|---|---|---|---|
| GB | 2370112 | A | 6/2002 |
| WO | 2006/094364 | A1 | 9/2006 |
| WO | 2008/006746 | A3 | 1/2008 |

* cited by examiner

*Primary Examiner* — Paul Hyun
(74) *Attorney, Agent, or Firm* — Dinsmore & Shohl LLP

(57) ABSTRACT

Systems, methods and multi-well plates comprising an array of wells for thermal treatment of chemical or biological samples are disclosed. Each of the wells comprises a bottom opening, an upper opening, inner side walls extending from the bottom opening to the upper opening, a protrusion extending from the inner side walls into the well with a first cross-sectional area and located at a height from the bottom opening which is smaller than the height from the upper opening. A sample chamber with a second cross-sectional area is formed between the bottom opening and the protrusion. An upper chamber with a third cross-sectional area is formed between the protrusion and the upper opening, and in which the first cross-sectional area is smaller than the third cross-sectional area and smaller than or equal to the second cross-sectional area.

15 Claims, 9 Drawing Sheets

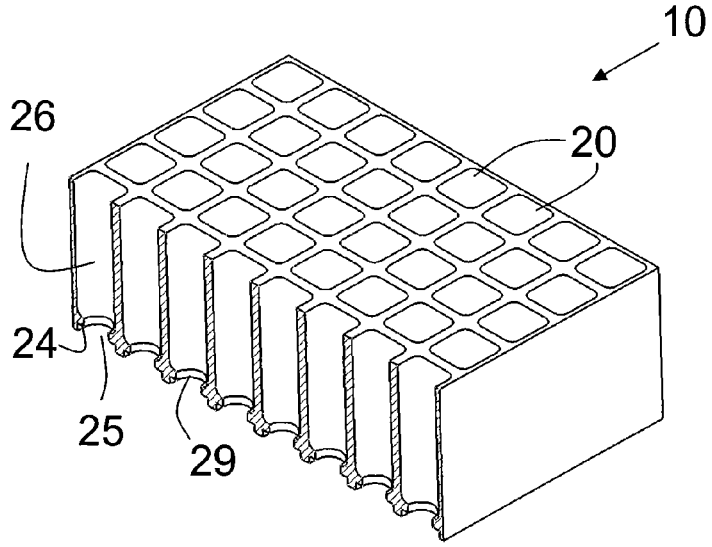
Fig. 3a
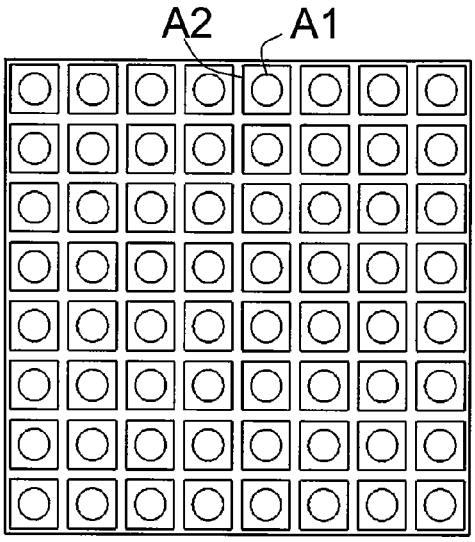
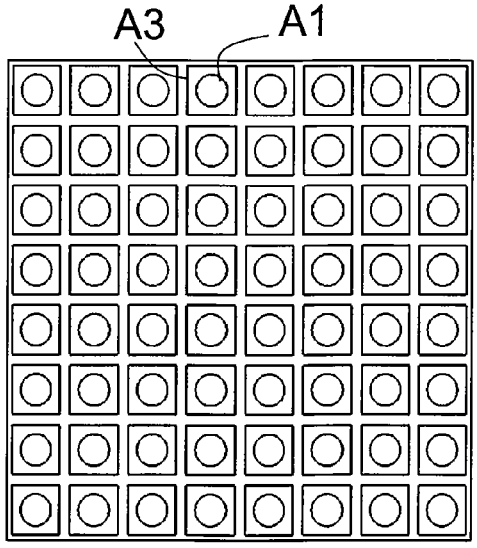
Fig. 3b
Fig. 3c

MULTI-WELL PLATE WITH TAILORED CHAMBERS

RELATED APPLICATIONS

This application claims priority to European patent application EP 08105327, filed Sep. 12, 2008.

TECHNICAL FIELD

Embodiments of the present invention relate generally to multiwell-plates used for processing samples, and particularly to a multi-well plate for thermally treating chemical or biological samples, to a method of using such a multi-well plate, and to a system comprising such a device.

BACKGROUND

Reactions that are conducted in solution such as, for example, chemical, biological, biochemical, molecular biological reactions, are mostly carried out within a chamber, well or other container, typically made of glass or plastic, and including, for example, test tubes, microcentrifuge tubes, and capillary tubes. There is an ever growing need to increase the throughput of such reactions, particularly with diagnostic assays and screening tests, and to make them faster, cheaper and simpler to perform while at least maintaining, if not increasing, precision and reliability of conventional laboratory processes.

In order to achieve the above mentioned goal, substantial effort has been devoted to miniaturization, parallelization, and integration of various process steps, e.g. by developing microtiter or multi-well plates and microfuidic chips. For example, multi-well plates with 1536 wells and standard footprint have been developed. Conventionally, however, when volumes decrease, other problems increase, such as imprecise liquid metering, liquid evaporation, inefficient mixing, adverse capillary effects due to an increased surface to volume ratio, difficult handling, positioning, optical detection. Moreover, many of the reactions mentioned above require thermal treatment and some require rapid temperature changes, e.g. PCR.

However, many reaction chambers materials are poor thermal conductors with large thermal time-constants and large thermal gradients and hence, long time lags are associated with changing the temperature of the reaction chamber and equilibration of a temperature change throughout the sample volume. Such leads to longer reaction times, non-uniform reaction conditions within a single reaction and lack of reproducibility among multiple reactions, both parallel and sequential.

For multi-well plates comprising up to about 384 wells and which still have relatively large reaction volumes, i.e. several microliters, it is possible to fit the outer side walls of the wells at the bottom of the plate into corresponding holes of a thermal block in order to improve thermal contact and minimize thermal gradients. Another problem, such as condensation at the inner side walls, can be prevented e.g. by heating a cover closing the wells from the top.

For multi-well plates with a higher number of wells, and smaller reaction volumes, however, the matching accuracy between the wells and the thermal block need to be extremely high, thus putting a high demand on manufacturing tolerances. Another problem is the tendency of the wells to deform and of the plate to get jammed with the thermal block.

US 2003/0170883 A1 discloses a multi-well plate that is manufactured from a thermally conductive material, which enables the wells to have relatively rigid walls and makes it easier to handle the multi-well plate. The thermally conductive material can be a metal or a mixture of a polymer and one or more thermally conductive additives. However, multi-well plates made of thermally conductive polymers have a series of disadvantages. In general, such multi-well plates are more expensive because either metal or polymer/additives mixtures are more expensive than basic polymers and because thermal conductive materials alone are not sufficient for some applications, meaning that a top layer of isolative material may be needed through which the temperature can drop. Using different materials in layers may introduce new problems due to selective shrinkage and consequent deformation. Moreover, during manufacture, typically by injection molding, there is a tendency of the additives to form aggregations, i.e. local concentration changes, leading to non-uniform thermal conductivity and thus to a reduced and/or unpredictable thermal performance. Also, the additives may increase the viscosity of the polymer such that injection molding is complicated or even impossible in narrow long flow paths.

US 2002/0072096 A1 discloses a microhole apparatus comprising a substrate, the substrate defining a plurality of sample chambers extending through the substrate and comprising hydrophobic and non-hydrophobic regions. The sample chambers can thus hold samples by surface tension in the form of a thin film, which enables rapid thermal equilibration. Multi-well plates comprising selective hydrophilic/hydrophobic regions require however a complex coating process raising the costs of manufacture. Also, the effect of the surface tension is very much dependent on the liquids used and on the presence of additives such as surfactants, ultimately leading to unpredictable or irreproducible performance. Moreover, stability of the coating, especially when exposed to high temperatures or repeated temperature cycles may be an issue. Also, due to the required aspect ratio of the chambers, a high well density is not obtainable.

SUMMARY

Embodiments of the present invention provide a multi-well plate, which enables fast, reliable, reproducible and high-throughput processing of small volumes of chemical or biological samples. In particular, embodiments of the present invention provide an optimized well geometry, which allows the boundaries of even a very small liquid sample to be confined in a preferred position of the well for thermal treatment.

In one embodiment, a multi-well plate comprising an array of wells for thermal treatment of chemical or biological samples is disclosed. Each of the wells comprises a bottom opening, an upper opening, and inner side walls extending from the bottom opening to the upper opening. A protrusion extends from the inner side walls into the well with a first cross-sectional area and is located at a height h2 from the bottom opening which is smaller than a height h3 from the upper opening. A low-thermal-resistance sample chamber with a second cross-sectional area is formed between the bottom opening and the protrusion. A high-thermal-resistance upper air chamber with a third cross-sectional area is formed between the protrusion and the upper opening, wherein the first cross-sectional area is smaller than the third cross-sectional area and smaller than or equal to the second cross-sectional area.

In another embodiment, a method for thermal treatment of chemical or biological samples is disclosed. The method comprises providing a multi-well plate according to an embodiment of the invention, dispensing samples into sample chambers via at least one of the upper air chambers of the wells and an integrated fluid-distribution system, and treating thermally the samples by exchanging heat primarily through at least one of the bottom opening and the bottom wall of the wells.

In still another embodiment, a system for the thermal treatment of chemical or biological samples is disclosed. The system comprises a multi-well plate according to an embodiment of the invention and having samples disposed in sample chambers thereof. A thermal block exchanges heat via at least one of the bottom opening and the bottom wall of the wells with the samples disposed in the sample chambers.

Although not limited thereto, the following advantages provided by the embodiments of the present invention are noted. One advantage of the embodiments of the present invention is that the manufacturing costs of the multi-well plate are low and the method of use is simple. A further advantage is that a large number of wells can be arrayed with a high density. Also, the volume reduction achieved by the embodiments of the present invention has the advantage to enable more tests per sample volume, or to run a test when sample availability is limited. Another advantage is the reduced consumption of reagents, meaning lower costs per test, less waste, with benefits for the user and the environment. Also, by reducing sample and reagent volumes, reactions reach completion more rapidly, thus reducing turnaround time. Another advantage is that for reactions requiring heat, equilibration of a temperature change throughout the sample volume is quick, due to minimized thermal time constants and thermal gradients across the sample. That is to say that a minimal thermal gradient across the sample can be obtained with a simple geometry, e.g. by heating through a flat bottom wall, and without the need for highly thermally conductive materials or multiple layers. A further advantage is that optical detection is enabled during or after reaction within the same well.

Further details and advantages of the present invention are illustrated in the following exemplary embodiments making reference to the attached drawings.

BRIEF DESCRIPTION OF THE DRAWINGS

FIGS. 3*a*, 3*b* and 3*c* show respectively a perspective cut view of a portion of one embodiment of the multi-well plate, a bottom view of the same embodiment and a top view of the same embodiment.

DETAILED DESCRIPTION

Figure 1:
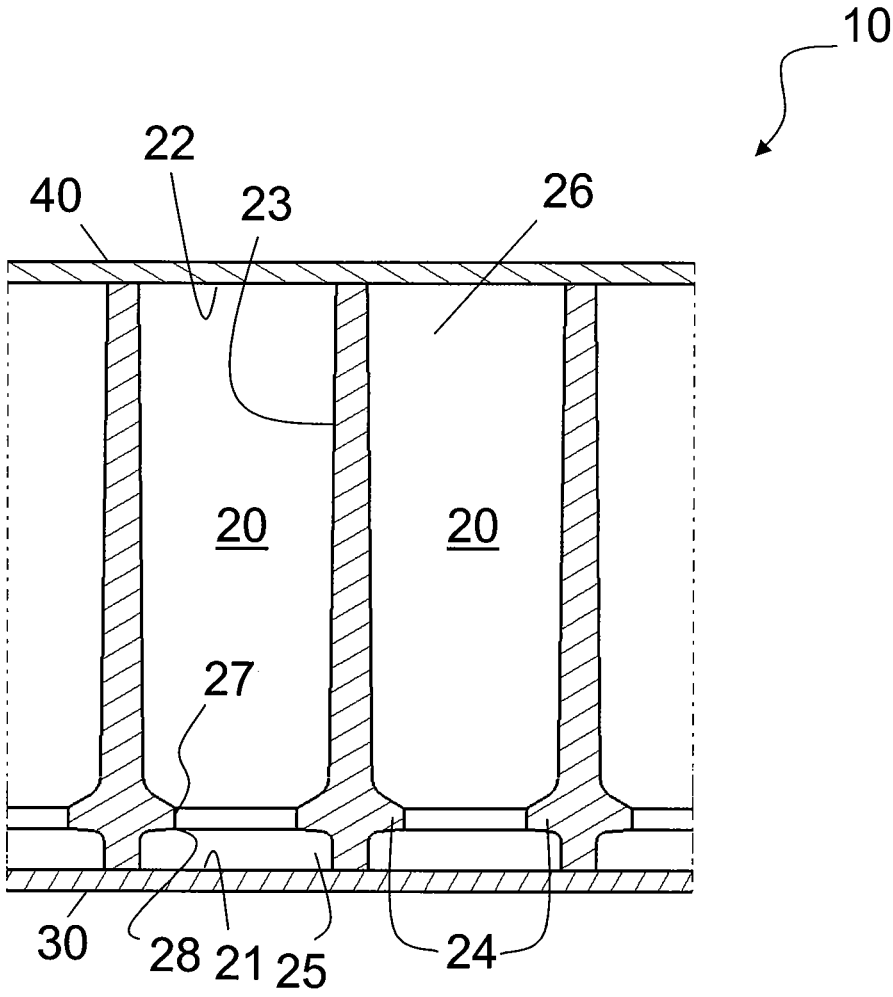
FIG. 1 shows a cross-section view of a portion of a multi-well plate comprising a bottom wall and a cover.

The following description of the embodiments is merely exemplary in nature and is in no way intended to limit the invention, its application, or uses. For example, the present invention may find utility in a wide variety of applications, such as in connection with Polymerase Chain Reaction (PCR) measurements; ELISA tests; DNA and RNA hybridizations; antibody titer determinations; protein, peptide, and immuno tests; recombinant DNA techniques; hormone and receptor binding tests; and the like. Additionally, the present invention is particularly well suited for use with luminescence, colorimetric, chemiluminescence, or radioactivity measurement such as scintillation measurements. Although the present invention will be discussed as it relates to Polymerase Chain Reaction measurements, such enabling discussion should not be regarded as limiting the present invention to only such applications.

In one embodiment, a multi-well plate comprising an array of wells for processing thermal treatment of chemical or biological samples is disclosed. The wells comprise a bottom opening, an upper opening, inner side walls extending from the bottom opening to the upper opening, and a protrusion extending from the inner side walls into the well with a first cross-sectional area and located at a distance from the bottom opening which is smaller than the distance from the upper opening. The wells also include a low-thermal-resistance sample chamber with a second cross-sectional area is formed between the bottom opening and the protrusion, and a high-thermal-resistance upper air chamber with a third cross-sectional area is formed between the protrusion and the upper opening. The first cross-sectional area is smaller than the third cross-sectional area and smaller than or equal to the second cross-sectional area.

As used herein, thermal treatment of chemical or biological samples concerns the processes by which relatively small volumes, typically below 200 microliter of chemical or biological samples are exposed to constant temperatures or temperature profiles. This includes for example freezing, thawing, melting of samples; keeping samples at an optimal temperature for a chemical or biological reaction or an assay to occur; subjecting samples to a temperature gradient, e.g. for detecting a characteristic of a sample like the melting point, or the presence of a certain DNA sequence; or subjecting samples to different temperatures varying with time, such as temperature profiles, including temperature cycles, like for example during PCR.

Each of the processes may involve adding or mixing one or more liquid solutions in order to carry out a chemical or biological reaction. Detecting the result of the reaction may be part of a process. A liquid solution may be the chemical or biological sample itself or any liquid reagent, e.g. a solvent or chemical solution, which needs to be mixed with a chemical or biological sample and/or other reagent in order e.g. for a reaction to occur, or to enable detection. A liquid reagent may be a diluting liquid, including water, it may comprise an organic solvent, a detergent, it may be a buffer. The liquid solution may contain one or more reactants, typically a compound or agent capable e.g. of binding to or transforming one or more analytes present in a sample. Examples of reactants are enzymes, enzyme substrates, conjugated dyes, protein-binding molecules, nucleic acid binding molecules, antibodies, chelating agents, promoters, inhibitors, epitopes, antigens, and the like.

Chemical samples can be for example pharmaceutical, cosmetic, environmental, inorganic and organic samples, and the like. The multi-well plate according to any of the various embodiments of the present invention can thus be adapted to carry out e.g. a plurality of chemical assays in parallel, like for example drug interaction screening, environmental analysis, identification of organic substances, and the like.

Biological samples can be for example body fluids, like blood, serum, urine, milk, saliva, cerebrospinal fluid, microbiological samples, cellular extracts, like e.g. protein samples or nucleic acid samples, and the like. According to a preferred embodiment, the analytical device is thus adapted to carry out a plurality of diagnostic assays like for example immunoassays and molecular biology assays, e.g. based on nucleic acid amplification, identification, quantitation.

According to one embodiment dry reagents or samples are present in the multi-well plate or added to the multi-well plate and may be dissolved by a sample, another reagent or a diluting liquid.

According to a preferred embodiment reagents form homogeneous mixtures with samples and the assay is a homogeneous assay. According to another preferred embodiment the assay is a heterogeneous assay. An example of heterogeneous assay is a heterogeneous immunoassay, wherein some of the reactants, in this case capturing antibodies, are immobilized on a solid support. Examples of solid supports are streptavidin coated beads, e.g. magnetic beads, or latex beads suspended in solution, used e.g. in latex agglutination and turbidimetric assays. Nucleic acid amplification is another example of assay where one of the reactants, e.g. oligonucleotide primers, may be immobilized, e.g. on a surface of the well.

A multi-well plate according to an embodiment of the present invention comprises an array of wells. According to a preferred embodiment the multi-well plate has the footprint of a standard multi-well plate, i.e. according to the SBS standard. According to one embodiment one or more multi-well plates fit into a holder plate with the footprint of a standard multi-well plate.

The array of wells may also be arranged in a way that the SBS standard, in terms of number and spacing or pitch is respected. For example the array may comprise 96 or 8×12 wells, 384 or 16×24 wells, 1536 or 32×48 wells, or any number of wells resulting from the expansion of this series.

According to another preferred embodiment the wells are arrayed in a more compact way, e.g. mimicking an hexagonal cell geometry.

According to another embodiment the wells may be arrayed according to any application-specific format.

A well according to an embodiment of the present invention has a vertical axis and comprises a bottom opening, an upper opening, inner side walls extending from the bottom opening to the upper opening, and a protrusion extending from the inner side walls into the well. According to a preferred embodiment the protrusion is a thickening of the inner side walls surrounding the well cavity towards the inside of the well with the effect of restricting the cross-sectional area of the well. As such the protrusion may be manufactured in one piece with the well, e.g. by injection molding. According to another embodiment the protrusion is a separate element, e.g. an annular ring, attached to the inner side walls of the well in order to achieve the same effect.

Preferably, in one embodiment the protrusion is continuous, i.e. present at 360 degrees around the inner side walls and has no cutouts or recesses. Preferably, in one embodiment the distance of the protrusion from the bottom opening is constant around 360 degrees. The protrusion is located at a distance from the bottom opening which is smaller than the distance from the upper opening. Preferably, the distance from the upper opening is greater than twice the distance from the bottom opening, the distance being calculated from the inner upper edge of the protrusion facing the upper opening and the inner lower edge of the protrusion facing the bottom opening respectively. The protrusion is so designed to confine the boundaries of a liquid sample contained in the sample chamber at a preferred position, e.g. by stabilizing the liquid meniscus. The protrusion thus divides the well in three sections, a sample chamber, an upper chamber, and an intermediate section respectively.

The intermediate section is defined by the space located between the inner upper edge of the protrusion and the inner lower edge of the protrusion and has a first cross-sectional area comprised in a plane passing horizontally through the protrusion and orthogonal to the vertical axis of the well. According to one particular embodiment the distance of the protrusion from the bottom opening is zero, meaning that the inner lower edge of the protrusion coincides with the edge of the bottom opening, and that the sample chamber is comprised in the intermediate section.

According to an embodiment of the present invention a sample chamber is that section of a well wherein processing of chemical or biological samples takes place. Typically, the volume of the sample chamber is comprised between 0.1 and 50 μL. Preferably between 0.1 and 10 μL. The sample chamber is defined by the space located between the bottom opening and the protrusion, or between the bottom opening and the inner lower edge of the protrusion, and has a second cross-sectional area comprised in a plane passing horizontally through the inner side walls below the protrusion and orthogonal to the vertical axis of the well. The upper chamber is defined by the space located between the upper opening and the protrusion, or between the upper opening and the inner upper edge of the protrusion and has a third cross-sectional area comprised in a plane passing horizontally through the inner side walls above the protrusion and orthogonal to the vertical axis of the well.

The multi-well plate according to an embodiment of the present invention may be made with common materials even with low thermal conductivity, e.g. with polymers such as Polypropylene, PVC, Polycarbonate, Cyclic Olefin Copolymers, Fluoropolymers, and Ceramics.

According to a preferred embodiment, the multi-well plate comprises a bottom wall sealing the bottom openings of the wells and thus providing a bottom wall to the sample chambers. According to a preferred embodiment, the bottom wall is a thin foil substantially flat. Preferably, the bottom wall is made of a material chosen from the group of polymers, metal, ceramics, or a combination thereof. According to one embodiment the bottom wall is made of the same material as the multi-well plate. According to one embodiment the bottom wall is manufactured in one piece with the multi-well plate, e.g. by injection molding.

According to an embodiment of the present invention the first cross-sectional area is smaller than the third cross-sectional area and smaller than or equal to the second cross-sectional area. According to a preferred embodiment the first cross-sectional area is substantially circular. However, a polygonal shape, preferably with smoothed corners, is also possible. According to a preferred embodiment the second cross-sectional area is substantially circular. According to another preferred embodiment the second cross-sectional area is polygonal, preferably substantially squared or hexagonal. However other polygonal shapes are also possible. According to a preferred embodiment the third cross-sectional area is substantially polygonal, preferably substantially squared or hexagonal. According to another embodiment the third cross-sectional area is circular.

The term substantially is here used to indicate a geometric approximation wherein e.g. circular includes also an oval shape and polygonal includes regular and irregular polygons, equilateral or not, with either smoothed or sharp corners and edges.

A geometry may be preferred to another because of different surface energy properties, e.g. it is known that a liquid may experience increased capillary forces at sharp edges and corners. Thus a substantially circular shape is e.g. preferred for the first cross-sectional area because of a more efficient stabilizing effect that this shape has on the meniscus of a liquid sample or liquid solution comprised in the sample chamber. A substantially circular shape is preferred for the second cross-sectional area e.g. because the risk to trap air bubbles is minimized.

A geometry may be preferred to another also because of manufacturing reasons. For example rounded corners and/or tapered shapes may be more convenient during a molding process.

A geometry may be preferred to another because it may confer different physical properties to the all multi-well plate. For example, a substantially squared or hexagonal shape is preferred for the third cross-sectional area because the wall thickness between adjacent wells, i.e. the distance between the inner side walls of two adjacent wells, can be minimized and is substantially constant around the well. In other words, the third cross-sectional area can be maximized. As a consequence, less material is used to manufacture the plate with reduced costs and a higher well density can be achieved. Another consequence is that a large difference in thermal resistance is obtained between the sample chamber containing a liquid sample or liquid solution and the upper chamber containing air, i.e. a low thermal resistance or high thermal conductivity for the sample chamber containing a liquid sample and a high thermal resistance or low thermal conductivity for the upper chamber containing air. This difference in thermal resistance is important when the multi-well plate is used for thermal treatment of chemical or biological samples. The larger this difference in thermal resistance is, the smaller is the thermal gradient across the sample when heating or cooling in the vertical direction, e.g. by exchanging heat through the bottom wall, thus resulting in quick equilibration of a temperature change and uniform temperature throughout the sample volume.

The thermal conductivity is defined as the quantity of heat, $\Delta Q$, transmitted during time $\Delta t$ through a thickness h, in a direction normal to a surface of an area A, due to a temperature difference $\Delta T$, under steady state conditions and when the heat transfer is dependent only on the temperature gradient.

Thus, in order to obtain a high thermal conductivity for the sample chamber containing a liquid sample and a high thermal resistance or low thermal conductivity for the upper chamber containing air, not only the third cross-sectional area has to be maximized but also the ratio between the height of the upper chamber and the height of the sample chamber has to be maximized.

In other words the best effect is achieved by shallow sample chambers and high upper chambers with large cross-sectional area. The size and shape of the protrusion and first-cross sectional area are important to confine a liquid sample in the sample chamber in this desired position and to stabilize the liquid meniscus. One should however take care that the sample chamber is not too shallow and the first cross-sectional area is not too small as this may cause unfavorable delivery of sample to the sample chamber, e.g. trapping of gas bubbles in the sample chamber. According to a preferred embodiment, the ratio between the height of the sample chamber and the diameter of the first cross-sectional area, assuming that this is substantially circular, is in the range of about 0.2 to about 0.5. According to a preferred embodiment, the ratio between the first cross-sectional area and the second cross-sectional area is in the range comprised between about 30% and about 80%, more preferably between 40% and 70%. However these values may depend on the samples used and the required thermal performance. According to one embodiment the ratio between the first cross-sectional area and the second cross-sectional area is 1.

According to a preferred embodiment the total height of the well is greater than five (5) times the height of the sample chamber, preferably greater than about 10 times the height of the sample chamber. According to a preferred embodiment the height of the upper chamber is greater than five (5) times the minimum thickness of a wall between two adjacent wells, preferably greater than eight (8) times that thickness.

Of course combinations of different embodiments on the same multi-well plate are also possible for particular applications.

The multi-well plate according to an embodiment of the present invention may comprise an integrated fluid-distribution system, such as a microfluidic structure comprising e.g. channels, air vents, inlet and outlet ports, valves, dosing structures, etc., to deliver either by external force, e.g. by pumping, vacuum, acceleration forces like centrifugal force, or by capillary force, chemical or biological samples or any liquid solutions to the sample chambers. According to another embodiment, an integrated fluid-distribution system may be realized in the form of a patterned or non-patterned coating e.g. on the inner side of the bottom wall.

Another embodiment of the present invention also refers to a method for thermal treatment of chemical or biological samples by using said multi-well plate. The method comprises providing said multi-well plate, dispensing chemical or biological samples into sample chambers via the upper chambers of the wells, e.g. by pipetting and/or applying an acceleration force, or via an integrated fluid-distribution system, and heating or cooling the chemical or biological samples by exchanging heat primarily through the bottom opening or bottom wall.

According to an embodiment of the present invention thermal treatment of chemical or biological samples concerns processes by which relatively small volumes, preferably in the range of the sample chamber volume, of chemical or biological samples are exposed to constant temperatures or temperature profiles. This includes for example freezing, thawing, melting of samples; keeping samples at an optimal temperature for a chemical or biological reaction or an assay to occur; subjecting samples to a temperature gradient, e.g. for detecting a characteristic of a sample like the melting point, or the presence of a certain DNA sequence; or subjecting samples to different temperatures varying with time, such as temperature profiles, including temperature cycles, like for example during PCR. Thus, according to a preferred embodiment the method comprises thermocycling the samples in the sample chambers. Preferably, the method comprises sealing the upper openings of the wells with a cover and optionally applying heat to the cover.

The cover is preferably made of a foil-like or thicker flexible or rigid material provided with or without a sealing coating or additional sealing layer, and is preferably optically transparent. According to one embodiment, the cover is the same as the bottom wall sealing the bottom openings of the wells. Sealing may be based on applying pressure, heat, adhesive or combinations thereof. According to a preferred embodiment a bottom wall is provided already attached to the multi-well plate while a cover is attached by the user.

According to another embodiment both a bottom wall and a cover are provided already attached to the multi-well plate, in which case liquid samples or any liquid solutions are delivered to the sample chambers preferably via an integrated fluid distribution system. The multi-well plate may already comprise reagents or samples, e.g. in dry form.

According to a preferred embodiment, the method further comprises optically analyzing the samples in the sample chambers, e.g. detecting the result of a chemical or biological reaction after it has been carried out or during the reaction in order to monitor its progress.

The present invention also refers to a method for processing chemical or biological samples by using said multi-well plate. The method comprises providing said multi-well plate, dispensing chemical or biological samples into sample chambers via the upper chambers of the wells, or via an integrated fluid-distribution system, and optically analyzing the samples in the sample chambers e.g. detecting the result of a chemical or biological reaction after it has been carried out or during the reaction in order to monitor its progress. The method may or may not include thermal treatment.

The method may further comprise isolating individual wells in case these were communicating, e.g. by closing channels of a fluid-distribution system after samples have been delivered to the sample chambers.

The present invention also refers to a system comprising said multi-well plate for the thermal treatment of chemical or biological samples. The system further comprises chemical or biological samples disposed in sample chambers, a thermal block exchanging heat via the bottom opening or bottom wall with the samples disposed in the sample chambers.

A thermal block according to the invention is a substrate or plate made of a thermally conductive material such as metal, e.g. Aluminum or Silver, that is in thermal contact, either by direct contact or through the contact with a bottom wall, with a sample being processed so that the temperature of the sample is affected by the temperature of the thermal block.

The thermal block may be part of a thermal block unit further comprising temperature regulating units such as Peltier elements, one or more heat sinks, temperature sensors, and the like.

According to one embodiment between the thermal block and the multi-well plate, either comprising a bottom wall or not, an intermediate highly thermal conductive foil-like material, with deformable properties, may be positioned in order to maximize thermal contact.

According to the invention, the sample chambers, having chemical or biological samples disposed therein, have a thermal resistance in vertical direction which is related to a vertical thermal resistance of the upper chambers such that a specified temperature gradient is obtained over the sample chambers with respect to a temperature gradient over the total height of the wells. This means that by choosing a certain well geometry, i.e. choosing a certain size and shape for the first, second and third cross-sectional area respectively, as well as choosing a certain height ratio for the sample chamber and upper chamber respectively, it is possible to obtain the desired temperature gradient profile in the vertical direction from the bottom opening to the upper opening.

Such a desired thermal profile is very steep across the sample contained in the sample chamber, with an angle close to 90°, meaning that the temperature drop across the sample is close to zero, i.e. the temperature is constant and homogeneous across the sample. In practice a temperature drop of about/below 2-3° C. across the sample is sufficient for most applications, including PCR, and the system according to the invention enables to reach this range, wherein the major temperature drop takes place across the upper chamber.

According to a preferred embodiment the system comprises a cover sealing the upper openings of the wells wherein the cover is preferably made of a foil-like or thicker flexible or rigid material provided with or without a sealing coating or additional sealing layer, and is preferably optically transparent. According to a preferred embodiment the system comprises a heating plate in thermal contact with said cover, which influences the thermal gradient profile in the well.

According to another preferred embodiment the system comprises an optical detection unit to analyze the result of the thermal treatment of the samples disposed in the sample chambers.

An optical detection unit, according to the present invention is a detection system for detecting the result or the effect of the thermal treatment of samples. The optical detection unit may comprise a light source, e.g. a xenon lamp, the optics, e.g. mirrors, lenses, optical filters, fiber optics, for guiding and filtering the light, one or more reference channels, a CCD camera, and the like.

More in detail, the various embodiments of the present invention are explained hereafter in conjunction with the following drawings.

FIG. 1 shows a cross-section view of a portion of a multi-well plate 10. The multi-well plate 10 comprises an array of wells 20 for processing chemical or biological samples. The wells 20 comprise a bottom opening 21, an upper opening 22, inner side walls 23 extending from the bottom opening 21 to the upper opening 22, and a protrusion 24 extending from the inner side walls 23 into the well 20. The protrusion 24 is located at a distance from the bottom opening 21 which is smaller than the distance from the upper opening 22. The distance from the upper opening 22 is greater than twice the distance from the bottom opening 21, the distance being calculated from the inner upper edge 27 of the protrusion facing the upper opening 22 and the inner lower edge 28 of the protrusion facing the bottom opening 21 respectively. The protrusion 24 is a thickening of the inner side walls 23 surrounding the well cavity towards the inside of the well 20 with the effect of restricting the cross-sectional area of the well 20. The protrusion 24 thus divides the well 20 in three sections, respectively a sample chamber 25, an upper chamber 26, and an intermediate section 29 defined by the space located between the inner upper edge 27 of the protrusion 24 and the inner lower edge 28 of the protrusion 24.

A bottom wall 30 and a cover 40 are also attached to the multi-well plate 10, the bottom wall 30 sealing the bottom openings 21, and the cover 40 sealing the upper openings 22, respectively. FIG. 1 shows also that the upper chambers 26 have a slightly tapered or conical geometry, i.e. they have a cross sectional area which becomes smaller from the top to the bottom. This may be preferred for manufacturing reasons.

Figure 2A:
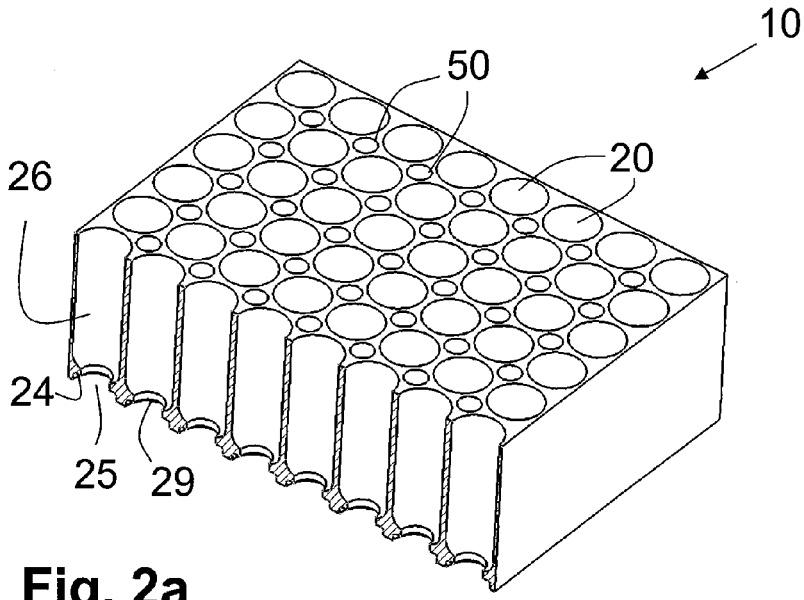
FIGS. 2*a*, 2*b* and 2*c* show respectively a perspective cut view of a portion of one embodiment of the multi-well plate, a bottom view of the same embodiment and a top view of the same embodiment.
Figure 2B:
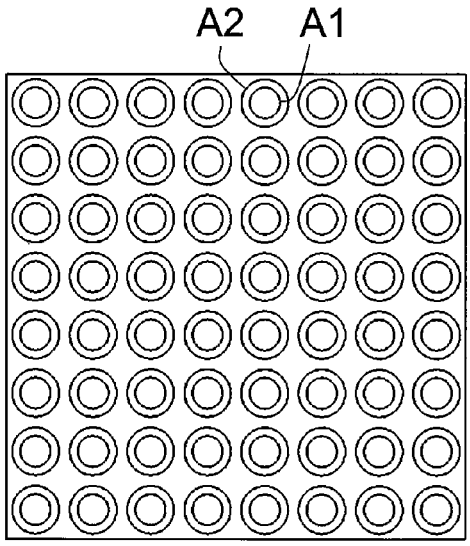
Figure 2C:
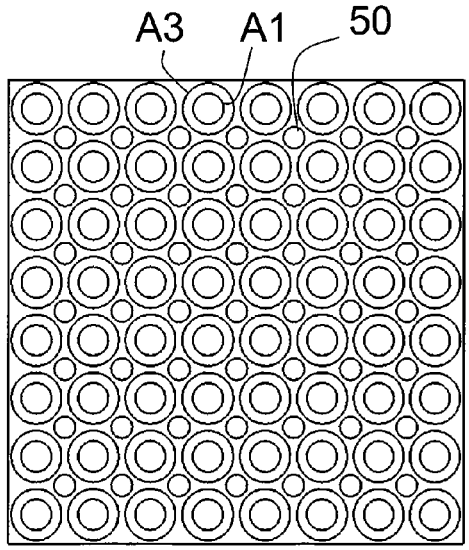

FIG. 2*a* shows a perspective view of a portion a multi-well plate 10 according to one embodiment, with one row of wells 20 cut longitudinally in the middle for clarity. A series of holes 50 between adjacent wells 20 in order to use less material and to obtain a larger difference in thermal resistance between the sample chamber 25 containing a liquid sample and the upper chamber 26 containing air. FIG. 2*b* is a bottom view of the same embodiment of FIG. 2*a* showing that the intermediate section 29 in correspondence of the protrusion 24 has a first cross-sectional area A1, which is smaller than the second cross-sectional area A2 of the sample chamber 25. Both cross-sectional areas A1 and A2 are substantially circular. FIG. 2*c* is a top view of the same embodiment of FIGS. 2*a* and 2*b* showing that the first cross-sectional area A1 is smaller than the third cross-sectional area A3 of the upper chamber 26. Also the cross-sectional area A3 is substantially circular.

FIG. 3*a* shows a perspective view of a portion a multi-well plate 10 according to another embodiment, with one row of wells 20 cut longitudinally in the middle for clarity. FIG. 3*b* is a bottom view of the same embodiment of FIG. 3*a* showing that the protrusion 24 has a first cross-sectional area A1, which is smaller than the second cross-sectional area A2 of the sample chamber 25. The cross-sectional areas A1 is substantially circular while the cross-sectional area A2 is substantially squared. FIG. 3*c* is a top view of the same embodiment of FIGS. 3*a* and 3*b* showing that the first cross-sectional area A1 is smaller than the third cross-sectional area A3 of the upper chamber 26. Also the cross-sectional area A3 is substantially squared.

Figure 4A:
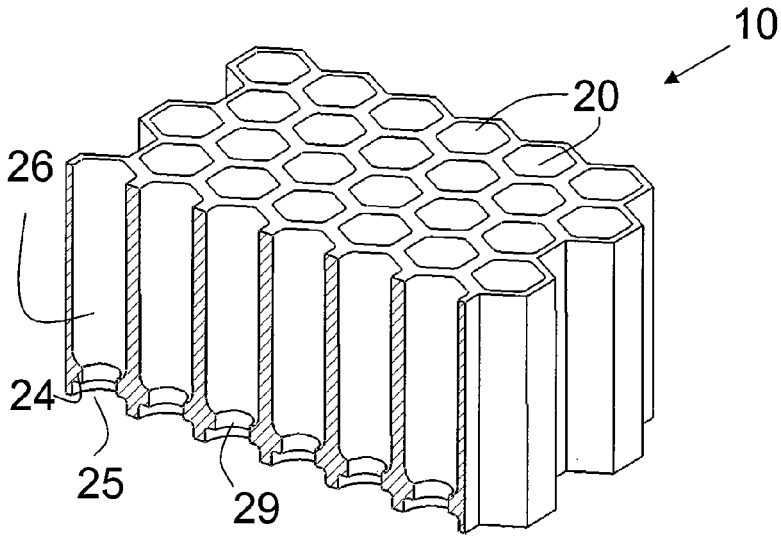
FIGS. 4*a*, 4*b* and 4*c* show respectively a perspective cut view of a portion of one embodiment of the multi-well plate, a bottom view of the same embodiment and a top view of the same embodiment.
Figure 4B:
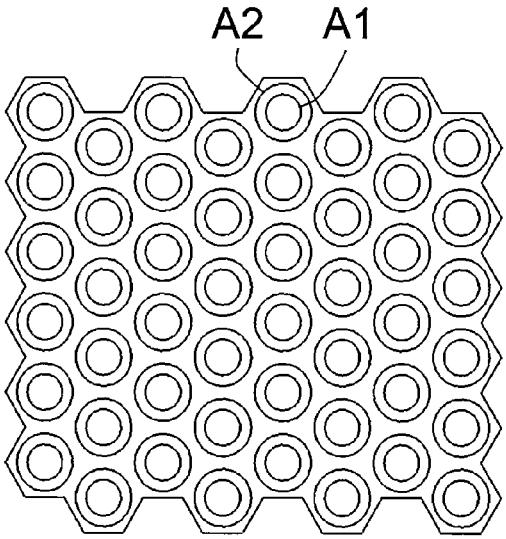

FIGS. 4*a* to 4*b* show embodiments similar to those shown in FIGS. 3*a* to 3*b* with the exception of the third cross-sectional area A3 of the upper chamber 26 being substantially hexagonal and the wells 20 being arrayed according to an hexagonal cell layout.

Figure 5A:
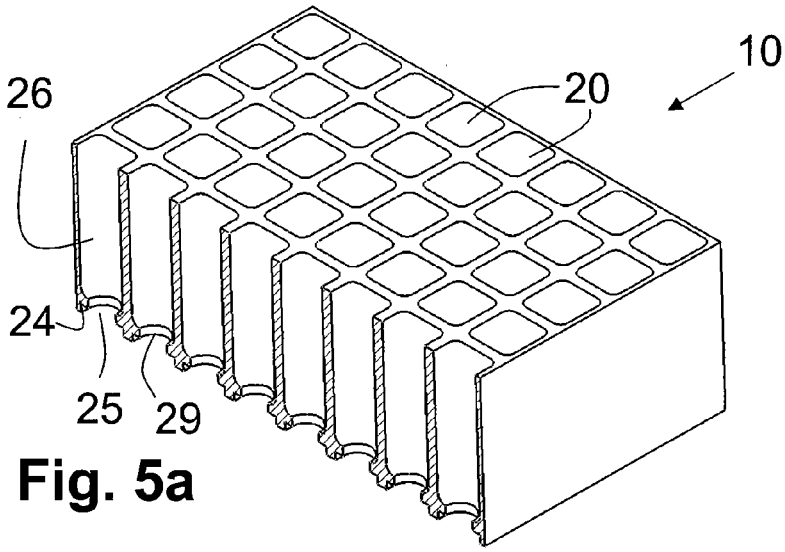
FIGS. 5*a*, 5*b* and 5*c* show respectively a perspective cut view of a portion of one embodiment of the multi-well plate, a bottom view of the same embodiment and a top view of the same embodiment.
Figure 5B:
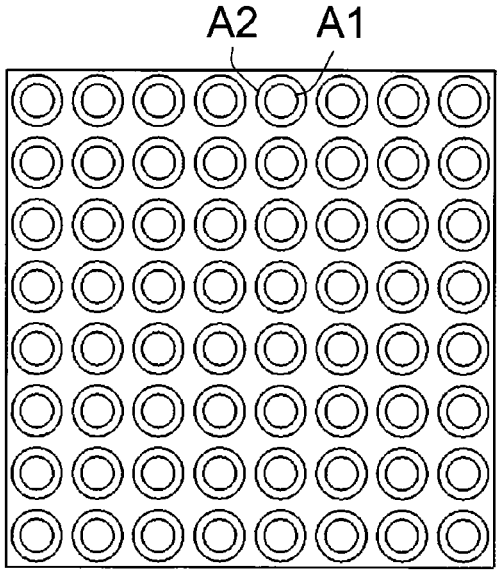

FIGS. 5*a* to 5*b* show embodiments similar to those shown in FIGS. 3*a* to 3*b* with the exception that the second cross-sectional area A2 of the sample chamber 25 is substantially circular while the third cross-sectional area A3 of the upper chamber 26 is substantially squared.

Figure 4C:
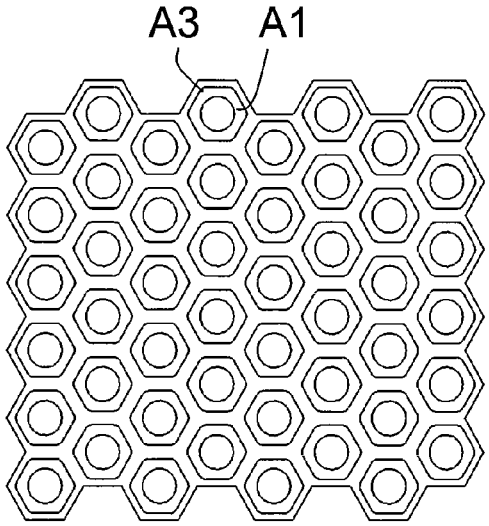

For the embodiment of FIGS. 3, 4 and 5 a larger difference in thermal resistance between the sample chamber 25 containing a liquid sample and the upper chamber 26 containing air is obtained compared to the embodiment of FIGS. 2.

FIGS. 6*a*, 6*b*, 6*c* and 6*d* indicate some typical dimensions for four different embodiments similar to the embodiments of FIGS. 2, 3, 4 and 5, respectively.

Figure 6A:
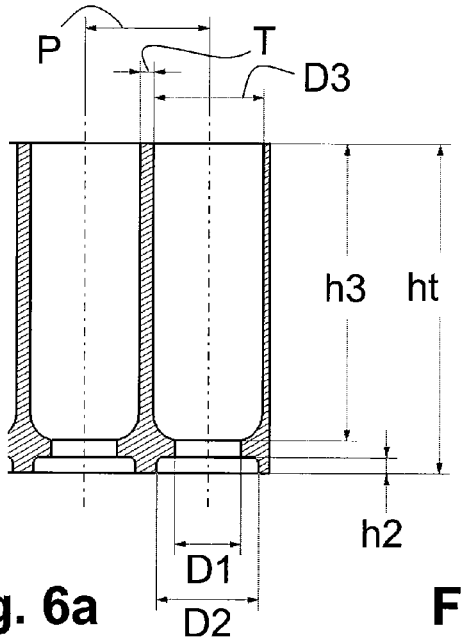
FIGS. 6*a*, 6*b*, 6*c* and 6*d* depict cross-section views indicating typical dimensions for four different embodiments similar to the embodiments of FIGS. 2, 3, 4 and 5, respectively.

In the embodiment depicted by FIG. 6*a*, the wells 20 have a total height ht of about 6 mm, wherein the sample chamber 25 has a height h2 of about 0.3 mm and the upper chamber 26 has a height h3 of about 5.4 mm. The first cross-sectional area A1, the second cross-sectional area A2 and the third cross-sectional area A3 are substantially circular, wherein A1 has a diameter D1 of 1.2 mm, A2 has a diameter D2, measured at the bottom opening 21, of about 1.82 mm and A3 has a diameter D3, measured at the upper opening 22, of about 2.0 mm. The well pitch P, i.e. the distance between the vertical axes of two adjacent wells 20 passing through their respective centers is about 2.25 mm. The thickness T of the wall, i.e. the shortest distance between two adjacent wells 20, measured at the upper opening 22, is about 0.25 mm.

Figure 6B:
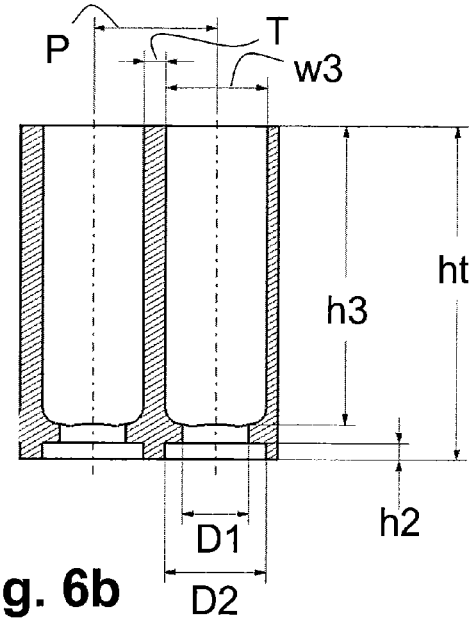

In the embodiment depicted by FIG. 6*b*, the wells 20 have a total height ht of about 6 mm, wherein the sample chamber 25 has a height h2 of about 0.3 mm and the upper chamber 26 has a height h3 of about 5.4 mm. The first cross-sectional area A1 is substantially circular, the second cross-sectional area A2 and the third cross-sectional area A3 are substantial squared, wherein A1 has a diameter D1 of about 1.2 mm, A2 has an width W2, i.e. the distance between two opposite inner side walls 23 and measured at the bottom opening 21, of about 1.85 mm and A3 has an width W3, i.e. the distance between two opposite inner side walls 23 and measured at the upper opening 22, of about 1.85 mm. The well pitch P is about 2.25 mm. The thickness T of the wall is about 0.4 mm.

Figure 6C:
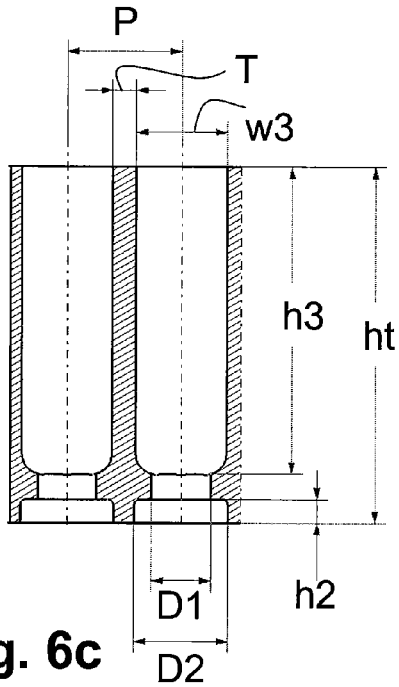

In the embodiment depicted by FIG. 6*c*, the wells 20 have a total height ht of about 6 mm, wherein the sample chamber 25 has a height h2 of about 0.4 mm and the upper chamber 26 has a height h3 of about 5.2 mm. The first cross-sectional area A1 and the second cross-sectional area A2 are substantially circular, and the third cross-sectional area A3 is substantial hexagonal, wherein A1 has a diameter D1 of about 1.0 mm, A2 has a diameter D2 of about 1.6 mm, and A3 has a width W3 of about 1.55 mm. The well pitch P is about 1.95 mm. The thickness T of the wall is about 0.4 mm.

Figure 6D:
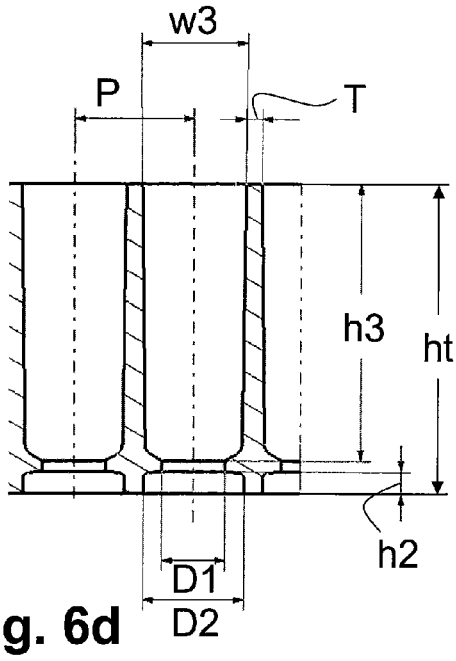

In the embodiment depicted by FIG. 6*d*, the wells 20 have a total height ht of about 5.7 mm, wherein the sample chamber 25 has a height h2 of about 0.4 mm and the upper chamber 26 has a height h3 of about 5.1 mm. The first cross-sectional area A1 and the second cross-sectional area A2 are substantially circular, and the third cross-sectional area A3 is substantial squared, wherein A1 has a diameter D1 of about 1.2 mm, A2 has a diameter D2 of about 1.9 mm, and A3 has a width W3 of about 1.4 mm. The well pitch P is about 2.25 mm. The thickness T of the wall is about 0.3 mm.

Figure 7:
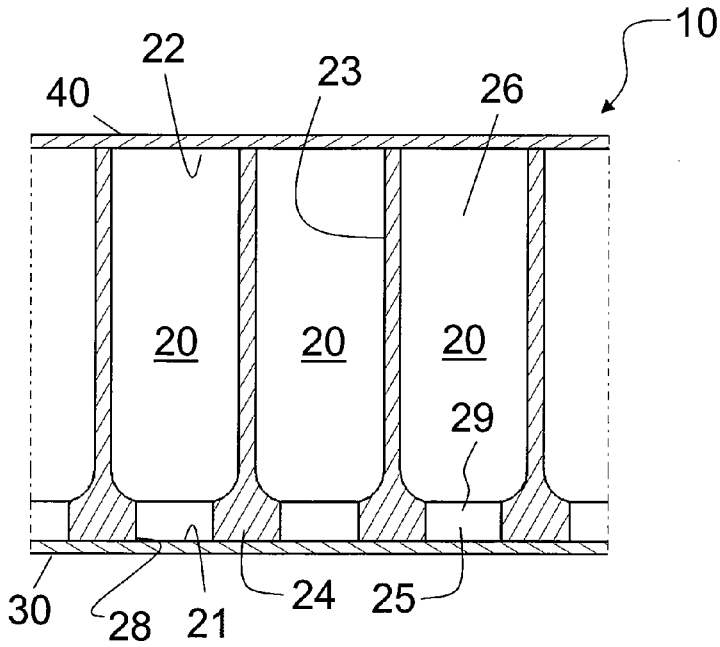
FIG. 7 shows a cross-section view of a portion of a particular embodiment of a multi-well plate according to the present invention.

FIG. 7 shows a perspective view of a portion of a particular embodiment of the multi-well plate 10, wherein the distance of the protrusion 24 from the bottom opening 21 is zero, meaning that the inner lower edge 28 of the protrusion 24 coincides with the edge of the bottom opening 21, and that the sample chamber 25 is comprised in the intermediate section 29.

FIGS. 8*a* to 8*g* show schematically different ways a liquid sample may be confined in a well of a multi-well plate embodiment.

FIG. 8*a* shows an ideal situation where the sample chamber 25 is completely filled; FIG. 8*b* shows a hypothetical situation where the well is partially filled with a substantially uniform liquid depth. FIGS. 8*c* and 8*d* show real situations wherein a meniscus is formed that is stabilized by the geometry of the sample chamber 25 and protrusion 24. Depending on the materials used, the use of surfactants and the wetting history, the meniscus may have different shapes, i.e. concave or convex respectively. FIG. 8*e* shows an over-filled situation. The situations shown in FIGS. 8*c* and 8*d* are more preferred from a thermal performance point of view. FIGS. 8*f* and 8*g* show the use of a cover layer 51 of for instance oil or wax, which may contribute to confine a liquid sample in the sample chamber, or may have other functions like preventing evaporation of the liquid sample underneath. The situation shown in FIG. 8*f* is again more preferred from a thermal performance point of view than the over-filled situation shown in FIG. 8*g*.

Figure 5C:
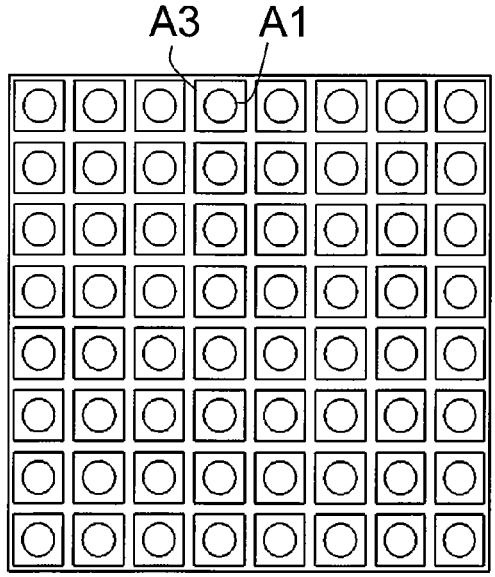
Figure 9:
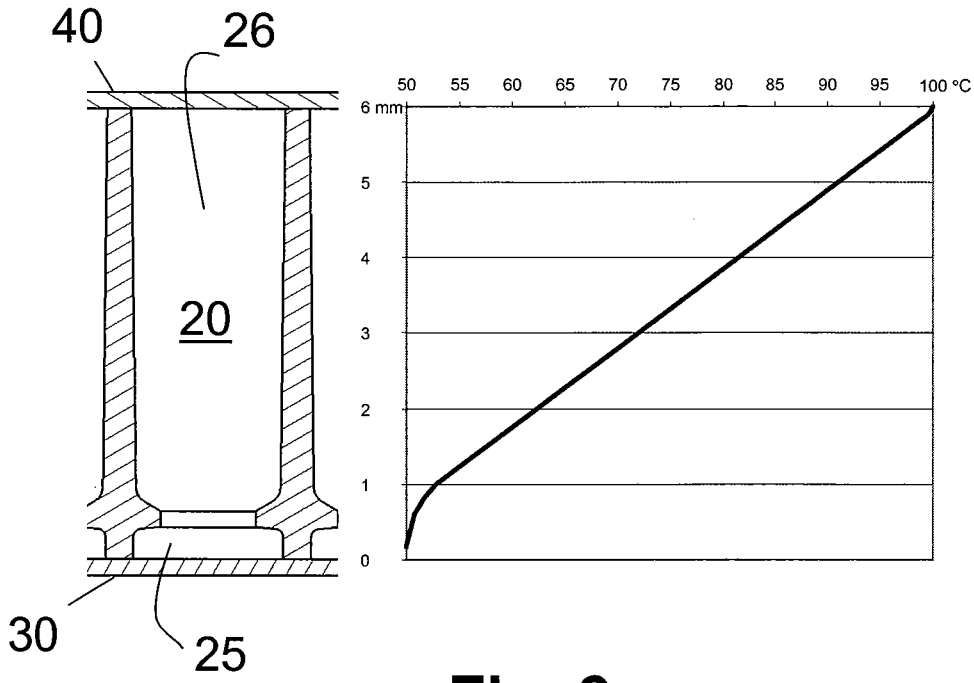
FIG. 9 depict a cross-section view, on the left side, of a portion of a particular embodiment of a multi-well plate and shows a graph, on the right side, representing a typical thermal gradient profile found in the vertical direction from a bottom opening to a upper opening of the well shown on the left side.

FIG. 9 shows on the right side a graph representing a typical thermal gradient profile, in the vertical direction from the bottom opening 21 to the upper opening 22 of a well 20, related in scale to the height ht of well 20 shown on the left side. It is to be appreciated that in the well-plate embodiment depicted on the left hand side of FIG. 9, areas A1 and A2 are substantially circular while area A3 is substantially squared such as, for example, as depicted by FIGS. 5*b* and 5*c*. A bottom wall 30 and a cover 40 are attached to the multi-well plate 10 and a sample (not shown) is contained in the sample chamber 25. The cover is heated at 100° C. while the bottom wall is heated at 50° C. These experimental conditions are similar to those used for example during a PCR cycle. It can be seen that the major temperature drop takes place across the upper chamber 26 while the profile is very steep across the sample contained in the sample chamber 25, with an angle close to 90°, meaning that the temperature drop across the sample is close to zero, i.e. the temperature is constant and homogeneous across the sample.

Figure 10:
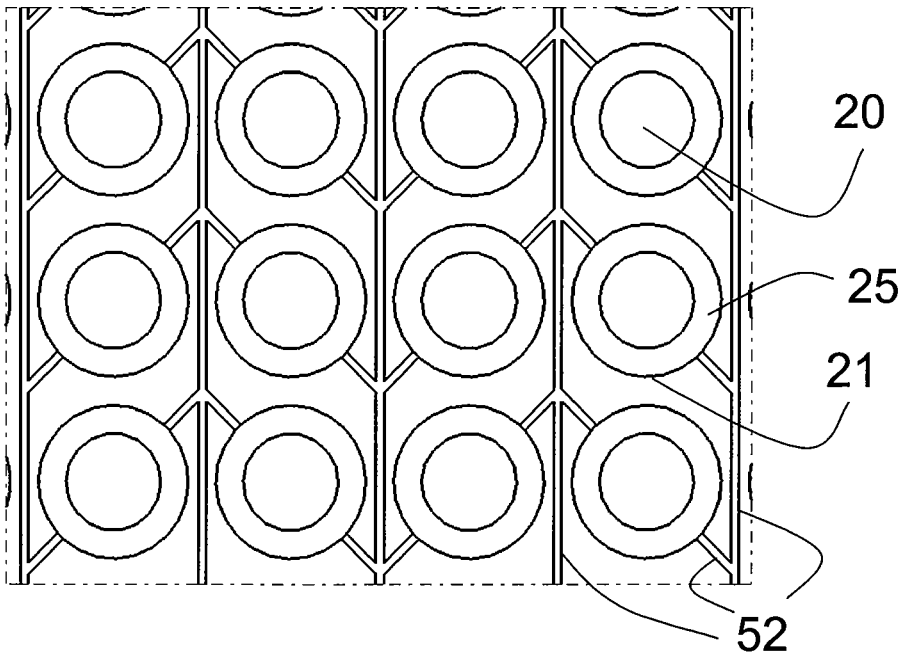
FIG. 10 shows schematically another embodiment having a fluid distribution system integrated with the multi-well plate according to the present invention.

FIG. 10 shows schematically an embodiment in which a fluid distribution system is integrated with a multi-well plate 10, comprising channels 52, at the bottom of the multi-well plate in communication with the bottom openings 21 of the wells 20, to deliver either by external force, e.g. by pumping or vacuum, or by capillary force, chemical or biological samples or any liquid solutions to the sample chambers 25. Other elements such as inlet and outlet ports, air vents, valves, dosing structures, and a bottom wall 30 are not shown.

Figure 8:
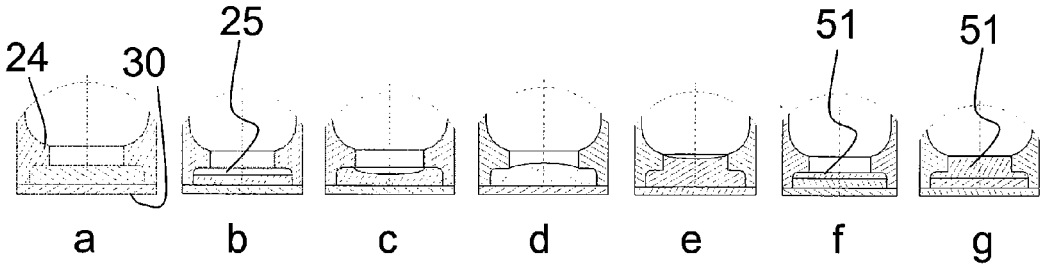
FIGS. 8*a* to 8*g* each depict a cross-section view of a portion of a particular embodiment of a multi-well plate and show schematically different ways a liquid sample may be confined in a well of the multi-well plate.
Figure 11:
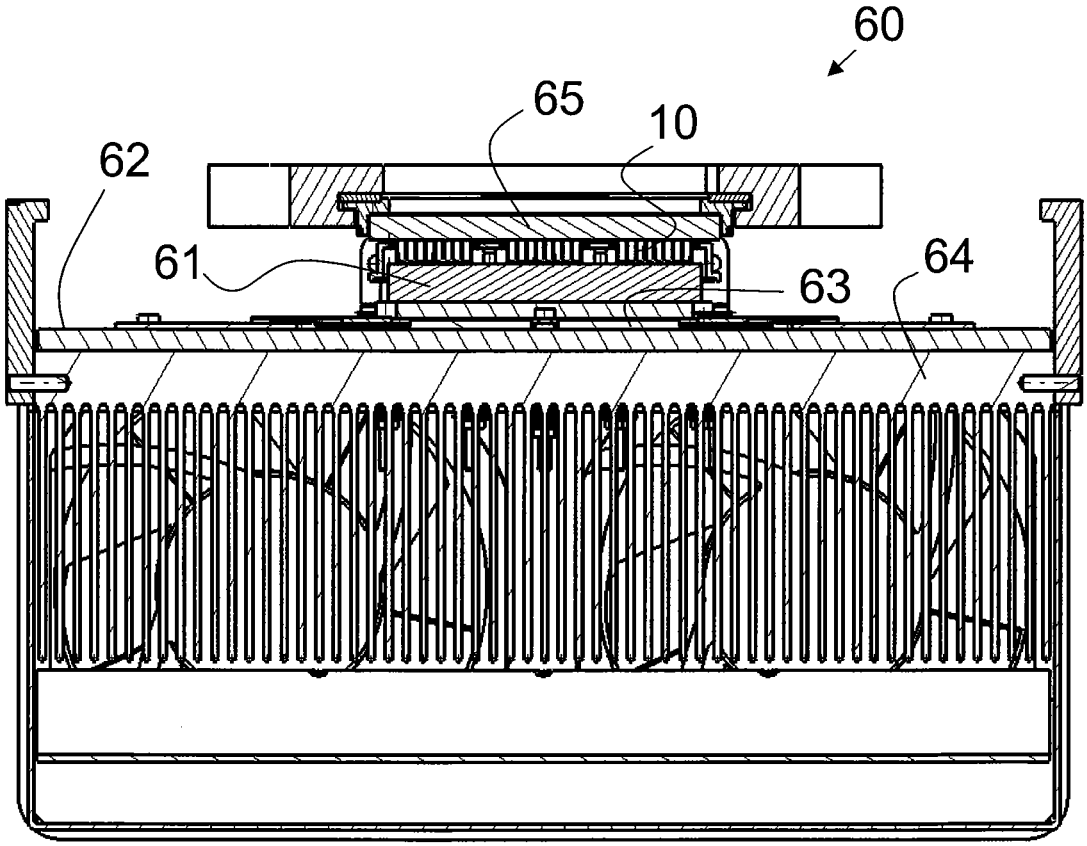
FIG. 11 shows schematically a system embodiment comprising a multi-well plate according to the present invention.

FIG. 11 shows schematically a system embodiment 60 for the thermal treatment of chemical or biological samples comprising a multi-well plate 10 as e.g. in FIG. 8, having chemical or biological samples disposed in sample chambers 25, and a thermal block 61 exchanging heat via the bottom wall 30 with the samples disposed in the sample chambers 25. The thermal block 61 is part of a thermal block unit 62 further comprising temperature regulating units such as Peltier elements 63 and a heat sink 64. The system further comprises a heating plate 65 in thermal contact with a transparent cover 40 sealing the upper openings 22 of the multi-well plate 10. The system further comprises an optical detection unit (not shown) to analyze the result of the thermal treatment of the samples disposed in the sample chambers 25 trough the optical transparent cover 40.

The above description and drawings are only to be considered illustrative of exemplary embodiments, which achieve the features and advantages of the present invention. Modification and substitutions can be made without departing from the spirit and scope of the present invention. Accordingly, the invention is not to be considered as being limited by the foregoing description and drawings, but is only limited by the scope of the appended claims.

What is claimed is:

1. A multi-well plate comprising an array of wells for thermal treatment of chemical or biological samples, each of the wells comprising:

a bottom opening;

a bottom wall sealing the bottom opening;

an upper opening;

inner side walls extending from the bottom opening to the upper opening;

a protrusion extending from the inner side walls into the well forming an intermediate section having a first cross-sectional area and located at a height h2 from the bottom opening which is less than a distance h3 from the upper opening;

a low-thermal-resistance sample chamber with a second cross-sectional area is formed between the bottom opening and the protrusion; and a high-thermal-resistance upper air chamber with a third cross-sectional area is formed between the protrusion and the upper opening, wherein the first cross-sectional area is less than the third cross-sectional area and the second cross-sectional area.

2. The multi-well plate according to claim 1 wherein the bottom wall is a thin foil substantially flat made of a material chosen from the group of polymers, metals, ceramics, and combinations thereof.

3. The multi-well plate according to claim 1 wherein the first cross-sectional area is substantially circular.

4. The multi-well plate according to claim 1 wherein the second cross-sectional area is a shape selected from substantially circular, polygonal, squared and hexagonal, the third cross-sectional area is a shape selected from substantially polygonal, circular, substantially squared, and hexagonal.

5. The multi-well plate according to claim 1 wherein the sample chamber has a volume ranging between about 0.1 and about 50 μL.

6. The multi-well plate according to claim 1 wherein a total height ht of the well is greater than five times the height h2.

7. The multi-well plate according to claim 1 wherein the distance h3 is greater than five times a minimum thickness T of a wall between two adjacent wells.

8. The multi-well plate according to claim 1 comprising an integrated fluid-distribution system.

9. A method for thermal treatment of chemical or biological samples comprising: providing a multi-well plate according to claim 1;

dispensing samples into sample chambers via at least one of the upper air chambers of the wells and an integrated fluid-distribution system; and treating thermally the samples by exchanging heat primarily through the bottom opening and the bottom wall of the wells.

10. The method according to claim 9 further comprising sealing the upper opening of the wells with a cover.

11. The method according to claim 9 further comprising optically analyzing the samples in the sample chambers.

12. A system for the thermal treatment of chemical or biological samples comprising:

a multi-well plate according to claim 1, having samples disposed in the sample chambers; and a thermal block exchanging heat via at least one of the bottom opening and bottom wall with the samples disposed in the sample chambers.

13. The system according to claim 12 wherein the sample chambers have a thermal resistance in vertical direction which is related to a vertical thermal resistance of the upper chambers such that a specified temperature gradient is obtained over the sample chambers with respect to a temperature gradient over a total height ht of the wells.

14. The system according to claim 12 further comprising a transparent cover sealing the upper opening of the wells.

15. The system according to claim 13 further comprising a cover sealing the upper opening of the wells, the cover being a material selected from a foil-like material, a thicker flexible material, and a rigid material.

* * * * *

UNITED STATES PATENT AND TRADEMARK OFFICE

CERTIFICATE OF CORRECTION

PATENT NO. : 8,808,647 B2
APPLICATION NO. : 12/556925
DATED : August 19, 2014
INVENTOR(S) : Claudio Cherubini et al.

It is certified that error appears in the above-identified patent and that said Letters Patent is hereby corrected as shown below:

In the Specification

Col. 1, Line 12,
"multiwell-plates used for processing samples, and particu-" should read
--multi-well plates used for processing samples, and particu- --;

Col. 3, Line 4,
"at least one of the bottom opening and the bottom wall of the" should read
--at least one of the bottom openings and the bottom wall of the--;

Col. 3, Line 11,
"one of the bottom opening and the bottom wall of the wells" should read
--one of the bottom openings and the bottom wall of the wells--;

Col. 4, Line 5,
"FIG. 9 depict a cross-section view, on the left side, of a" should read
--FIG. 9 depicts a cross-section view, on the left side, of a--;

Col. 4, Line 9,
"bottom opening to a upper opening of the well shown on the" should read
--bottom opening to an upper opening of the well shown on the--;

Col. 4, Line 44,
"sample chamber with a second cross-sectional area is formed" should read
--sample chamber with a second cross-sectional area formed--;

Col. 5, Line 59,
"arrayed in a more compact way, e.g. mimicking an hexagonal" should read
--arrayed in a more compact way, e.g. mimicking a hexagonal--;

Signed and Sealed this
Fifth Day of May, 2015

Michelle K. Lee

Michelle K. Lee
*Director of the United States Patent and Trademark Office*

Col. 7, Line 19,
"The term substantially is here used to indicate a geometric" should read
--The term "substantially" is used here to indicate a geometric--;

Col. 8, Line 10 and 11,
"sectional area. The size and shape of the protrusion and first-cross sectional area are important to confine a liquid sample in" should read
--sectional area. The size and shape of the protrusion and first cross-sectional area are important to confine a liquid sample in--;

Col. 11, Line 37,
"hexagonal and the wells 20 being arrayed according to an" should read
--hexagonal and the wells 20 being arrayed according to a--;

Col. 12, Line 3,
"A2 and the third cross-sectional area A3 are substantial" should read
--A2 and the third cross-sectional area A3 are substantially--;

Col. 12, Line 5,
"has an width W2, i.e. the distance between two opposite inner" should read
--has a width W2, i.e. the distance between two opposite inner--;

Col. 12, Line 7,
"1.85 mm and A23 has an width W3, i.e. the distance between" should read
--1.85 mm and A23 has a width W3, i.e. the distance between--;

Col. 12, Line 16,
"circular, and the third cross-sectional area A3 is substantial" should read
--circular, and the third cross-sectional area A3 is substantially--;

Col. 12, Line 26,
"circular, and the third cross-sectional area A3 is substantial" should read
--circular, and the third cross-sectional area A3 is substantially--; and Col. 13, Line 32,
"disposed in the sample chambers 25 trough the optical trans-" should read
--disposed in the sample chambers 25 through the optical trans- --.